United States Patent [19]

Jenne

[11] Patent Number: 5,069,011

[45] Date of Patent: Dec. 3, 1991

[54] PORTABLE ACOUSTICAL PANEL STRUCTURE

[75] Inventor: James F. Jenne, Palos Verdes Estates, Calif.

[73] Assignee: Grosh Scenic Studios, Inc., Hollywood, Calif.

[21] Appl. No.: 506,869

[22] Filed: Apr. 6, 1990

[51] Int. Cl.[5] ..... E04B 1/82

[52] U.S. Cl. ..... 52/144; 52/73; 160/135

[58] Field of Search ..... 52/144, 145, 71, 73; 160/135, 351; 181/30, 287

[56] References Cited

U.S. PATENT DOCUMENTS

| | | | |
|---|---|---|---|
| 3,180,446 | 4/1965 | Wenger | 52/73 X |
| 3,630,309 | 12/1971 | Wenger | 160/135 X |
| 3,908,787 | 9/1975 | Wenger et al. | 160/135 X |
| 4,241,777 | 12/1980 | Wenger et al. | 160/135 |
| 4,807,411 | 2/1989 | Capaul | 52/144 |

*Primary Examiner*—Richard E. Chilcot, Jr.
*Assistant Examiner*—Creighton Smith
*Attorney, Agent, or Firm*—Roth & Goldman

[57] ABSTRACT

A lightweight portable acoustical panel for stage or theatrical use which can be oriented in either an upright position or in a sideways position is provided with a weighted supporting base having a roller thereon which is disposed at one corner only of the panel structure whereby the structure can be easily moved about.

9 Claims, 1 Drawing Sheet

FIG. 1
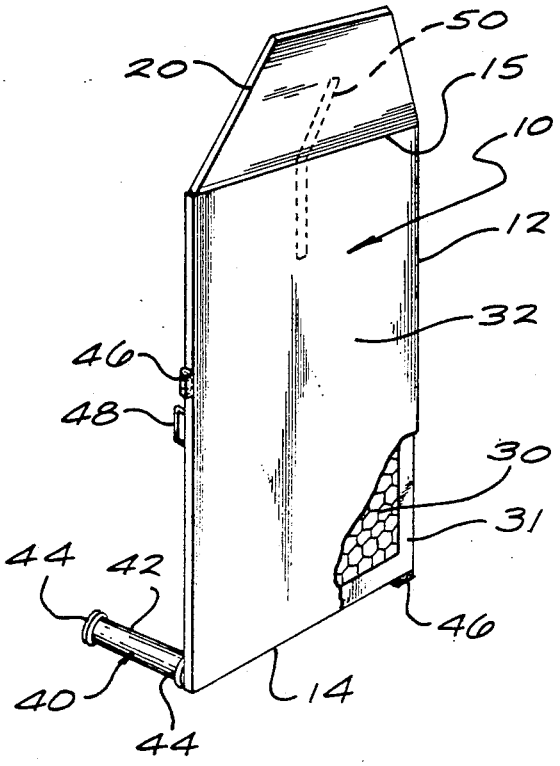
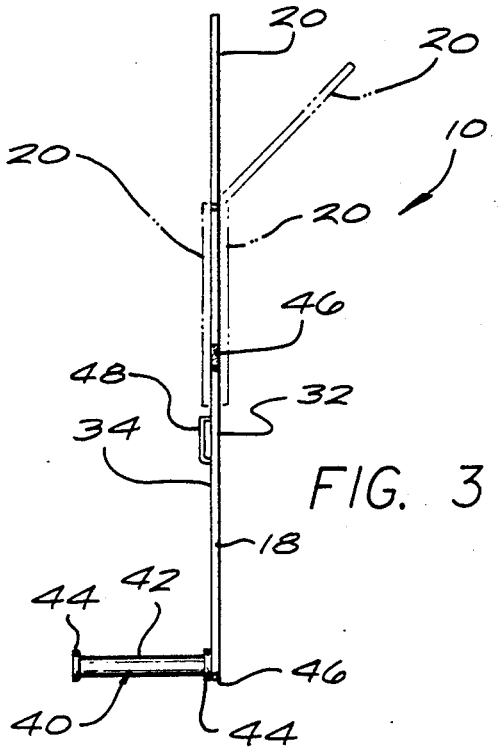
FIG. 3
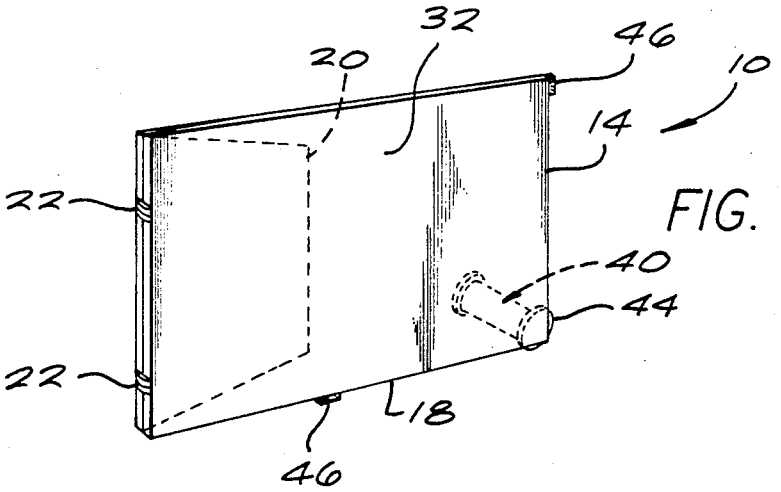
FIG. 2
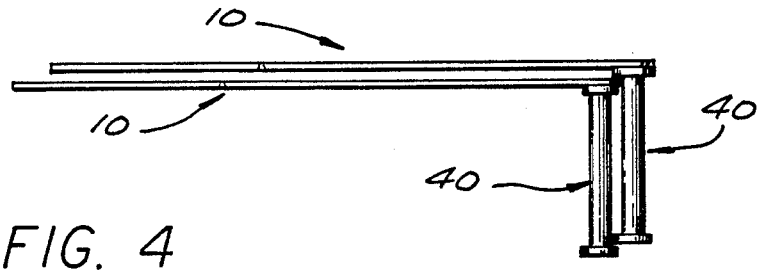
FIG. 4

PORTABLE ACOUSTICAL PANEL STRUCTURE

BACKGROUND OF THE INVENTION AND PRIOR ART

The present invention relates to portable acoustical panels used in theatrical or stage performances to reflect and enhance the sound produced by an orchestra or band or by actors in a play. Such devices usually are assembled by placing a plurality of panels in adjacent relationship so as to form a screen or shell. The panels are ordinarily foldable for storage or to selectively vary the shell configuration when the panels are disposed in operative position. Each foldable panel usually has a top or canopy panel which may be disposed vertically or at a selected angle to the vertical, often facing forwardly toward the audience, to focus the acoustical reflection in the desired direction.

U.S. Pat. No. 3,180,446, issued Apr. 27, 1965 to Wenger, discloses a portable sound shell constructed in sections whereby the shell may be folded for storage about a horizontally extending fold line. The shell panels are supported by rigid but collapsible vertically extending standards and rigid feet which extend both forwardly and rearwardly of the panels are attached thereto at either lateral side of the individual panels.

U.S. Pat. No. 3,630,309, issued Dec. 28, 1971 to Wenger, relates to a portable acoustical shell structure which is carried on a base which may be provided with a plurality of casters. The panels are stiffened at the panel periphery and at selected central locations by rigid frame members. The supporting base extends rearwardly of the panel structure and is connected to the upright frame members at both side edges of the panels to balance and support the upwardly freestanding structure.

U.S. Pat. No. 4,241,777, issued Dec. 30, 1980 to Wenger, discloses a portable lightweight panel construction useable as a room divider or acoustical panel which is detachably mounted to a supporting framework for mounting in either a support position or a storage position. Legs which extend both forwardly and rearwardly at each side of the structure are connectable to the panel framework at several different elevations to provide for different operative elevations for the shell.

There is a need in the art for a simplified lightweight easily transportable acoustical panel construction which may be oriented in different configurations and which does not employ heavy and dangerous panel fastening and adjustment brackets. For ease of operation and storage, the acoustical panel structure should be easily foldable and transportable by a single individual and a plurality of panel structures should be easily placed closely together for storage.

SUMMARY OF THE INVENTION

The present invention accordingly provides a portable acoustical panel structure comprising:

a) a main acoustical panel of substantially rectangular configuration and having a first free edge intended to rest proximate a floor or supporting stage;

b) a canopy panel hingedly affixed to said main panel for pivotal movement with regard to said main panel about a pivot axis substantially parallel to said first free edge between an operative position and an inoperative position;

c) an elongated weighted supporting base having at least one support roller thereon, said base being affixed to said main acoustical panel proximate a corner thereof formed between said first free edge and a second free edge, said base extending substantially perpendicular to a plane defined by said first and said second free edges and said base being of sufficient weight to balance and support said panel structure in operative position when said first free edge is proximate the floor or supporting stage; and said panels being constructed of a lightweight honeycomb core having a rigid sheet material adhesively bonded to oppositely facing surfaces of said honeycomb core.

BRIEF DESCRIPTION OF THE DRAWINGS

FIG. 1 is a perspective elevation view, partly broken away, of a panel structure constructed according to the teachings of the invention showing a canopy panel disposed in operative position angled slightly forwardly of the main panel to face an audience;

FIG. 2 is a perspective view of the panel structure of FIG. 1 oriented on its side with the canopy panel folded to the rear of and adjacent the main panel;

FIG. 3 is a side elevation view of the panel structure of FIG. 1; and

FIG. 4 is a top plan view of two panel structures stored in closely adjacent relation to each other.

DESCRIPTION OF THE PREFERRED EMBODIMENT

As seen in FIG. 1, the acoustical panel structure 10 of the present invention comprises a rectangular main panel 12 which extends substantially from a first free edge 14 closely adjacent the floor or supporting stage upwardly to a hinged junction 16 with a canopy panel 20 which may be rectangular or, as shown, of trapezoidal configuration whereby the forwardly angled canopy panels of a number of adjacently placed panel structures will substantially abut each other when the panel structures are arranged in a C-shaped configuration facing an audience.

The canopy panel 20 is hingedly connected to the upper narrow edge 15 of the main panel by double acting hinges 22 whereby the canopy panel 20 may be folded from an operative position as shown in FIG. 1 to an inoperative or storage position folded alongside of either the front or the rear side of the main panel 12. Such double acting hinges 22 are well known and therefore need not be described in detail.

Both the main panel 12 and the canopy panel 20 are preferably constructed of lightweight honeycomb core structure 30 such as craft paper or the like and having a hard surface sheet 32, 34 such as a laminate of plastic material such as FORMICA (Trademark) adhesively bonded to each side of the honeycomb core 30 as seen in the broken away portion of FIG. 1. A lightweight tubular metal frame 31 may be provided to surround the honeycomb core 30 and be sandwiched between the hard surface sheets 32, 34 to provide structural rigidity to the structure. The surface sheets 32, 34 are each preferably of a high density plastic suitable for receiving paint for scenic background uses.

Without limitation, it has been found that lightweight honeycomb core panels constructed in this fashion will weigh no more than about 1½ to 2 lbs. per square foot if the panels are made about 1⅛ inches thick as is typical for constructions of this type. A presently preferred panel structure employs a main panel of about 9'4" high by 6' wide and a canopy panel of about 6' wide at its hinged edge and about 4' high. The total weight of the two panels of this structure, not including the weight of the supporting base which will be described below, is about 120 lbs. Thus, the maximum lifting force required to lift the panels if one corner is supported on the floor is no more than about 60–65 lbs. which is well within the strength of most individuals.

This relatively lightweight panel structure has led to the construction of the present invention wherein a novel type of supporting base 40 is employed to permit the panel structure to be easily tilted and moved about by a single individual so that it can be oriented either vertically as in the prior art, or horizontally as shown in FIG. 2, for easy passage through a doorway of conventional height or used in other operative configurations or for storage.

Tilting and movement of the panel structure 10 is made possible by the use of a weighted supporting base comprised of a preferably solid steel bar 42 which is alternatively easily affixed, as by bolts, to either the front or, as shown, to the rear surface of the main panel 12 adjacent a lower corner thereof. The supporting base 40 has at least one, and preferably two, rollers 44 or supporting wheels thereon arranged such that the periphery of the roller 44 extends slightly beyond the adjacent free edges 14, 18 of the main panel which form the corner nearest the floor or supporting stage. Supporting feet 46 of plastic or rubber are affixed to the same two free edges 14, 18 of the main panel 12 in the locations best seen in FIGS. 1 and 2 to provide second points of support for the panel structure remote from the supporting roller 44.

A handle 48 is affixed to at least one side of the main panel near the elongated edge 18 which has the supporting foot 46 whereby one individual can easily tip and support the panel structure with most of the weight on the roller 44 for movement of the panel structure to the desired location for operation in either an upright position or in a sideways disposed operable position or for storage.

Since the weighted base 40 and supporting wheels or rollers 44 are provided only at one of the two lower corners of the main panel, a plurality of panel structures can be stored in closely adjacent relationship as seen in FIG. 4.

A rigid angle bracket 50 for affixing the canopy panel 20 either in an angled operative position (usually about 37½ degrees from vertical), as shown in FIG. 1 and in phantom in FIG. 3, or in an upright operative position as seen in FIG. 3, is received in brackets affixed to the rear surface of the main panel 12 and the canopy panel 20 to hold the canopy panel in the desired position.

A presently preferred embodiment of the invention employs only one main panel which, due to its relatively light weight compared to the prior art, is of substantially larger dimensions (about 9½ feet by 6 feet) yet, being of lighter weight, can be easily tipped to its side for movement through doors or for operative uses which do not require the full extended height of the panel structure. The canopy panel 20 can be folded to either the front or to the rear side of the main panel 12 and the hard surface sheets 32, 34 on the panels can be provided in different colors, e.g., one grey or white and one wood grain for aesthetics and can be painted on either side with scenery so that either side of the panels can be used as desired. When oriented on its side, the panel structure of the present invention can also be used as a temporary dressing room.

Persons skilled in the art will readily appreciate that various modifications can be made from the preferred embodiment thus the scope of protection is intended to be defined only by the limitations of the appended claims.

I claim:

1. A portable acoustical panel structure comprising:

a) a main acoustical panel of substantially rectangular configuration and having a first free edge intended to rest proximate a floor or supporting stage;

b) a canopy panel hingedly affixed to said main panel for pivotal movement with regard to said main panel about a pivot axis substantially parallel to said first free edge between an operative position and an inoperative position;

c) an elongated weighted supporting base having at least one support roller thereon, said base being affixed to said main acoustical panel proximate a corner thereof formed between said first free edge and a second free edge, said base extending substantially perpendicular to a plane defined by said first and said second free edges and said base being of sufficient weight to balance and support said panel structure in operative position when said first free edge is proximate the floor or supporting stage;

said panels being constructed of a lightweight honeycomb core having a rigid sheet material adhesively bonded to oppositely facing surfaces of said honeycomb core, and wherein said main panel is hingedly connected to said canopy panel by a two way hinge whereby said canopy panel may be folded adjacent and parallel to either side of said main panel such that both sides of each of said panels are useable.

2. The acoustical panel structure of claim 1, wherein said roller is disposed to support said corner of the structure with either said first or said second free edge parallel to the floor and slightly spaced thereabove.

3. The acoustical panel structure of claim 2, wherein said main panel has a narrow rectangular dimension of no more than about 6 feet whereby said panel structure can be supported on its long dimension and rolled through a doorway of standard height.

4. The acoustical panel structure of claim 2 wherein at least one of said main panel and said canopy panel is constructed of a lightweight honeycomb core having a high density plastic laminate cover sheet adhesively bonded to two oppositely facing surfaces of said honeycomb core.

5. The acoustical panel structure of claim 4, further comprising a tubular metal frame between said laminated cover sheets and substantially surrounding said core and wherein the weight of said panel does not exceed about 2 pounds per square foot of surface area as measured from one panel side.

6. The acoustical panel structure of claim 3, wherein the combined weight of said main panel and said canopy panel is not more than about 130 pounds.

7. The acoustical panel structure of claim 6 wherein the long dimension of said main panel is about 9 feet.

8. The acoustical panel structure of claim 7 wherein the short or width dimension of said main panel is about 6 feet.

9. A portable acoustical panel structure comprising:

a) a main acoustical panel of substantially rectangular configuration and having a first free edge intended to rest proximate a floor or supporting stage;

b) a canopy panel hingedly affixed to said main panel for pivotal movement with regard to said main panel about a pivot axis substantially parallel to said first free edge between an operative position and an inoperative position;

c) an elongated weighted supporting base having at least one support roller thereon, said base being affixed to said main acoustical panel proximate a corner thereof formed between said first free edge and a second free edge, said base extending substantially perpendicular to a plane defined by said first and said second free edges and said base being of sufficient weight to balance and support said panel structure in operative position when said first free edge is proximate the floor or supporting stage;

said panels being constructed of a lightweight honeycomb core having a rigid sheet material adhesively bonded to oppositely facing surfaces of said honeycomb core, said roller being disposed to support said corner of the structure with either said first or said second free edge parallel to the floor and slightly spaced thereabove, wherein said base is attachable to either the front or the rear surface of the main panel.

* * * * *